United States Patent [19]

Keeler

[11] Patent Number: 4,893,364

[45] Date of Patent: Jan. 16, 1990

[54] WATER-RECYCLING SHOWER

[76] Inventor: Francis R. Keeler, 505 Great Plain Ave., Needham, Mass. 02192

[21] Appl. No.: 197,586

[22] Filed: May 23, 1988

[51] Int. Cl.[4] ..... A47K 4/00

[52] U.S. Cl. ..... 4/597; 4/602; 4/603; 137/393

[58] Field of Search ..... 4/596, 599, 601, 603, 4/616, 597, 625, 662, 602, 624, 663, 322, 318, 598; 210/86, 97, 123, 127, 195.1; 137/563, 568, 393, 396

[56] References Cited

U.S. PATENT DOCUMENTS

| | | | |
|---|---|---|---|
| 1,065,265 | 6/1913 | Nordmark | 4/601 |
| 2,308,452 | 1/1943 | Ortyl | 4/603 |
| 3,606,618 | 9/1971 | Veech | 4/603 |
| 4,115,879 | 9/1978 | Toms | 4/322 |
| 4,224,700 | 9/1980 | Bloys | 4/603 |
| 4,413,363 | 11/1983 | Troiano | 4/603 |

FOREIGN PATENT DOCUMENTS

| | | | |
|---|---|---|---|
| 2432292 | 4/1980 | France | 4/597 |
| 2459643 | 2/1981 | France | 4/597 |
| 2565811 | 12/1985 | France | 4/597 |
| 1071023 | 4/1986 | Japan | 4/602 |

*Primary Examiner*—Henry J. Recla
*Assistant Examiner*—Glenn T. Barrett
*Attorney, Agent, or Firm*—William Nitkin

[57] ABSTRACT

A water recycling shower wherein water once used in the showering process is held in a storage tank and recycled during a portion of the showering process in place of fresh water.

3 Claims, 2 Drawing Sheets

WATER-RECYCLING SHOWER

BACKGROUND OF THE INVENTION

1. Field of the Invention

The structure of this invention relates to a water-recycling shower and more particularly relates to a shower structure for the storage and recirculation of water in motor homes, boats and the like to effect a conservation of water wherein water, once used in the showering process, is held in a storage tank and recycled during a portion of the showering process in place of fresh water in order to effect a conservation of water which structure is especially useful under conditions of limited availability of water.

2. Description of the Prior Art

In motor homes, boats, airplanes and the like, shower units are often provided which units have limited supplies of water available. Water-conserving showers are further desired in areas where the conservation of water is important and such water savings are sometimes accomplished by restricting the volume of water flow and by making the shower spray fine droplets at high velocity. Portable showers with tanks are also known in the prior art such as disclosed in U.S. Pat. Nos. 1,065,265; 2,308,452; 3,606,618 and 4,413,363. Water conservation showers to recycle rinse water are also known in the prior art such as seen in U.S. Pat. No. 4,224,700.

SUMMARY OF THE INVENTION

It is an object of this invention to provide a system for the conservation of water in showers.

It is a further object of this invention to provide a system for the conservation of water used during showers in motor homes, boats, airplanes and the like wherein water used for the washing cycle is recirculated after it has been initially run through the shower. In this way fresh water from water storage tanks is significantly conserved and the need to replenish such storage tanks is lessened.

The device of this invention incorporates a typical stall shower with a shower head interconnected to water pipes with typical hot and cold water faucet controls thereon. Under the floor of the stall shower upon which the user stands while taking a shower is a water storage tank interconnected to the water drain on the shower floor into which the water coming from the shower head after spraying on the user drains and collects in the storage tank. Such water is then recycled through a flow control valve which, when desired by the user, shuts off the incoming fresh water and recycles the water from the storage tank. When the user is ready to rinse the soap from his body, the use of recycled water from the water storage tank can be discontinued and fresh water can then be dispensed from the shower head. Thus a significant savings in total shower water usage can be accomplished by recycling a portion of the shower water.

DESCRIPTION OF THE PREFERRED EMBODIMENT(S)

Figure 1:
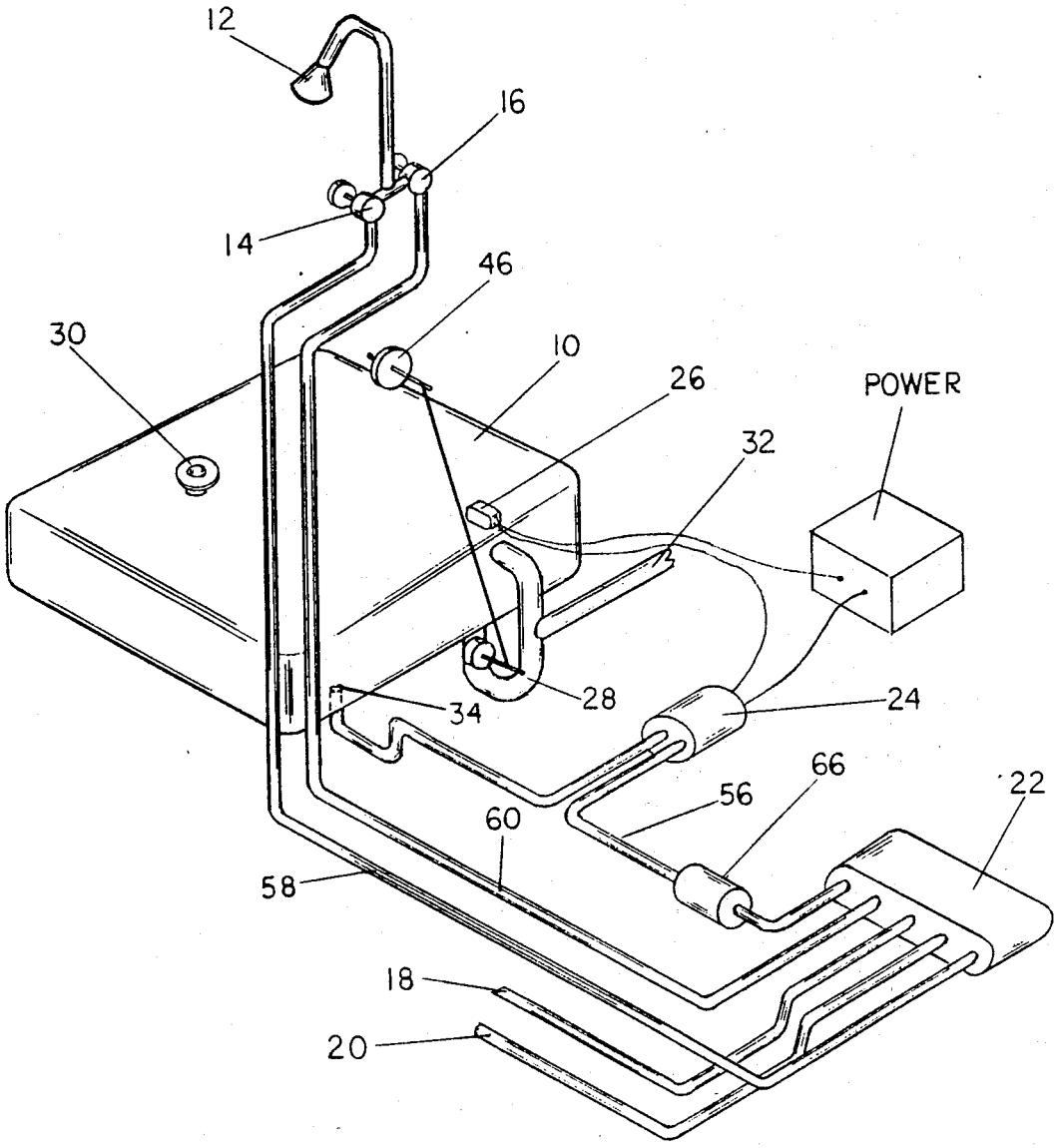
FIG. 1 illustrates a perspective view of the system of this invention apart from any shower stall structure.
Figure 2:
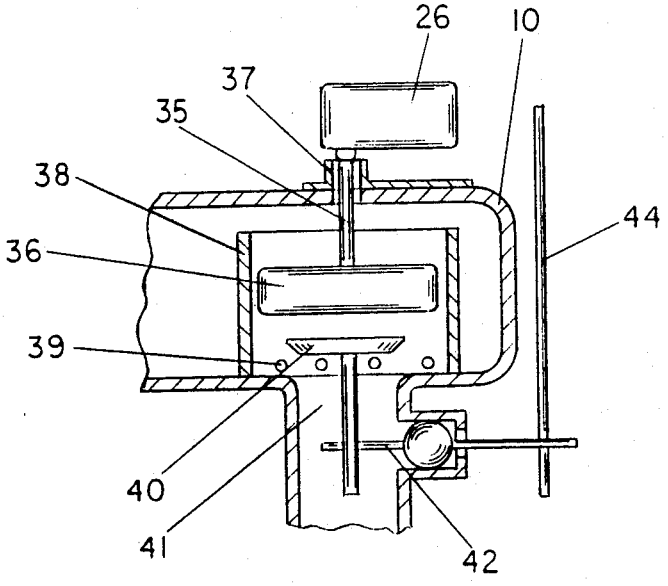
FIG. 2 illustrates a cross-sectional view of the drain valve of this invention.

FIG. 1 illustrates a shower system separated from the shower stall structure which would normally surround it. Such a system could be utilized, as mentioned above, in a motor home, boat, or airplane or other structure where the supply of water is limited. Shower head 12 is attached to hot and cold water pipes 58 and 60, respectively which have on line typical hot water faucet 14 and cold water faucet 16. In using the shower of this invention, the user would turn on the shower faucets, stand on the shower stall floor, soap up and rinse in the usual manner. On the floor of the shower is drain 30 into which all of the water coming out of the shower head drains but in the system of this invention such water is then retained in water storage tank 10 which is disposed below the floor of the shower. This water storage tank has within it a drain such as through P-trap 28 which can, when desired, drain the used water out outlet 32. Drain 41 can be sealed, as seen in FIG. 2, by the user moving drain plug control handle 46, seen in FIG. 1, which pulls upward drain plug control shaft 44 which then moves drain plug lever 42 forcing drain plug 40 downward to block drain outlet 41 thereunder. When this plugging action takes place, water will fill water storage tank 10. Disposed above drain outlet 41 is float chamber 38 which consists of a cylindrical wall member extending upward within water storage tank 10 above and around drain outlet 41 almost to the top of the inside of water storage tank 10. Float 36 extends substantially across the area defined within float chamber 38. At the bottom of float chamber 38 is disposed a plurality of float chamber apertures 39. Float 36 is attached to microswitch 26 by shaft 35 which shaft extends out of the top of tank 10 through shaft aperture 37. Water rises in water storage tank 10 and passes through float chamber apertures 39 and later flows over the top of the walls of float chamber 38. If drain plug 40 is open, the water passes from float chamber 38 through float chamber apertures 39 out drain outlet 41. If drain plug 40 is closed, then float chamber 38 fills with water as water is collected in water storage tank 10 and float 36 rises causing microswitch 26 to switch. Microswitch 26, after switching, completes an electric power circuit to electric pump 24 as seen in FIG. 1 which pump starts to pump water from recycle outlet 34 disposed in the bottom of water storage tank 10. Thus used water is then pumped through recycle water pipe 56 to flow control valve 22. In an alternate embodiment, an in-line heater 66 can be provided on the recycle water pipe line to warm the recycled water emanating from water storage tank 10.

Figure 3:
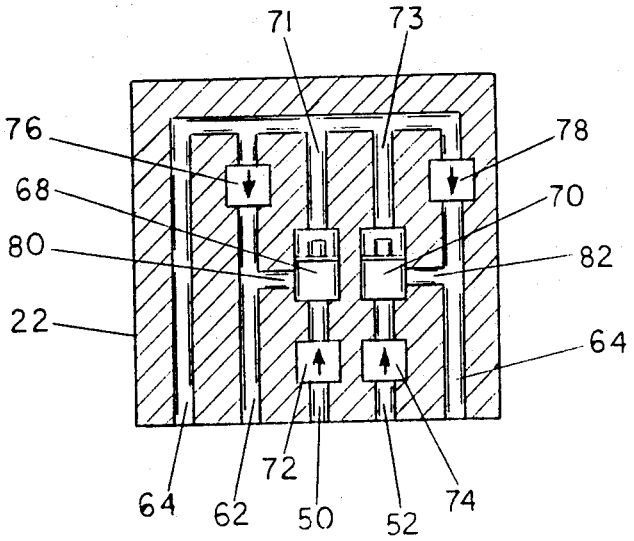
FIG. 3 illustrates a cut-away view through the flow control valve of this invention.

As seen in FIG. 3 flow control valve 22 in its non-recycle mode receives fresh water from its source, such as from storage tanks not shown, through cold water supply pipe 18 and from hot water supply pipe 20 to cold water inlet pipe 50 and hot water inlet pipes 52. As stated above, when the shower is operating in its non-recycle mode, the cold water passes, for example, through cold water inlet pipe 50 by cold water one-way check valve 72 which allows the water to travel only in the direction of the arrow which is the direction of fresh cold water flow to first pressure valve 68 which, in a first mode, allows the cold water to pass thereby along first joiner pipe 80 to cold water outlet pipe 62 where it then runs along cold water pipe 60 which extends to cold water faucet 16. In a like manner the hot water travels from hot water supply pipe 20 through hot water inlet pipe 52 by hot water one-way check valve 74 to second pressure valve 70 which allows the water to continue in such pressure valve's first mode through second joiner pipe 82 to hot water outlet pipe 64 where the hot water then flows to the shower through hot water pipe 58 to hot water faucet 14 after which point the hot and cold waters are mixed.

When the shower of this invention is placed in its recycle mode by the closing of drain plug control handle 46, drain 41 is closed and water fills water storage tank 10 causing float 36 in float chamber 38 to rise which moves shaft 35 upwards thereby switching microswitch 26 to activate pump 24 which then starts to pump water out of the bottom of water storage tank 10 from recycle outlet 34 through recycle water pipe 56 where it enters recycle water inlet pipe 54 to flow control valve 22. This water flow extends along recycle water inlet pipe 54 to several positions in flow control valve 22 as described below. By passing through first pressure valve control pipe 71 and second pressure valve control pipe 73 the pressure from the recycle water flow as caused by pump 24 then comes to the rear portion of first pressure-activated valve 68 and second pressure-activated valve 70, such water pressure switching them to their second pressurized mode which causes those valves to shut off the flow of fresh water from cold water inlet pipe 50 and hot water inlet pipe 52. This action stops the flow of fresh water through flow control valve 22 to the shower head. The recycled water also at that point passes through first recycle water one-way check valve 76 on cold water outlet pipe 62 and second recycle water check valve 78 on hot water outlet pipe 64 which path allows the recycled water to be circulated through outlet pipes 62 and 64 along pipes 60 and 58 to the hot and cold water faucets 14 and 16 and ultimately to shower head 12 where it is sprayed onto the user. Check valves 76 and 78 prevent, in their first modes, any water passing from fresh cold water inlet pipe 50 and hot water inlet pipe 52 into recycle water inlet pipe 54. Likewise check valve 72 and 74 prevent recycled water from passing from recycle water inlet pipe 54 into cold and hot water inlet pipes 50 and 52. When the user desires to rinse his body with fresh water, he maneuvers drain plug control handle 46 to open drain plug 40 in drain outlet 41 allowing the water to drain through P-trap 28 and out waste water outlet 32. Float chamber 38 then empties quickly causing float 36 to drop shutting off interconnected microswitch 26 thereby deactivating pump 24. The rest of the water in water storage tank 10 drains more slowly through float chamber apertures 39 than the water in float chamber 38 drains through drain outlet 41. It is desirable for float chamber 38 to drain quickly to allow float 36 to drop quickly otherwise it would float in an active position if water storage tank 10 were without a float chamber until a great deal of the entire water storage tank 10 drained. Another important feature of float chamber 38 is that if the shower of this invention were installed in a boat or airplane that rocked if no float chamber were utilized, the water in water storage tank 10 would slosh back and forth intermittently floating float 36. Float chamber 38 prevents such undesired intermittent float movement by substantially retaining water under float 36 until drain 41 is opened. When pump 24 is deactivated, first pressure valve 68 and second pressure valve 70 no longer have water pressure thereagainst emanating through first pressure valve control pipe 71 and second pressure valve control pipe 73 and therefore return to their first mode to allow cold water to pass from cold water supply pipe 18 and hot water from hot water supply pipe 20 through cold water inlet pipe 50 and hot water inlet pipe 52 which fresh water then passes through first and second joiner pipes 80 and 82 and out cold water outlet pipe 62 and hot water outlet pipe 64 to be used in the shower for rinsing. The fresh water now cannot flow backwards through first recycle water one-way check valve 76 and second recycle water one-way check valve 78 which valves prevent the fresh water from entering into the recycle system. Thus by use of drain plug control handle 46 one can activate very simply the system of this invention to use the recycled water in the shower for the washing process and then use fresh water for the rinsing process which will save considerably on the amount of water utilized in total during the showering process.

In some cases in order for pressure-activated valves 68 and 70 to switch properly from their first to second modes of operation and from their second to first modes of operation, one may have to closely balance the pressures on each side of such valves and should pressure be too great from the fresh cold water supply and fresh hot water supply to be offset by the pressure of the water in the recycle water inlet pipe 54 caused by the force of pump 24, mechanical restrictors can be placed on the fresh water incoming lines so as to help balance the pressures so that the system will alternately work using either recycle or fresh water as desired by the user.

Although the present invention has been described with reference to particular embodiments, it will be apparent to those skilled in the art that variations and modifications can be substituted therefor without departing from the principles and spirit of the invention.

I claim:

1. A shower of the type providing hot and cold water inlets receiving water from hot and cold fresh water sources to a shower head disposed within a shower area having a floor upon which the user stands, said floor having a water shower drain therein, comprising:

a water storage tank disposed to receive water from said water shower drain;

a tank drain defined in said water storage tank;

a recycle water outlet defined at the bottom of said water storage tank;

a recycle water pipe having a first and second end, said first end connected to said recycle water outlet;

means to sense when said water storage tank contains a predetermined amount of water therein;

a pump positioned in line on said recycle water pipe;

means to activate said pump, said means controlled by said means to sense a predetermined amount of water in said water storage tank; and means to direct water flow to said hot and cold water inlets of said shower, said means including means to receive water from said water storage tank pumped through said second end of said recycle water pipe and to direct such water to said hot and cold water inlets of said shower head while at the same time ceasing flow of hot and cold water from said fresh water sources, said means to direct water flow controlled by water pressure from said recycle water pipe such that in a first mode when no water pressure is in said water recycle pipe, fresh water reaches said shower head and in a second mode when pressure is present in said water recycle pipe, said pressure causes said means to direct water flow to enter a second mode and cease the flow of fresh hot and cold water from its fresh water sources and to then direct the water from said water storage tank to said hot and cold water inlets of said shower head.

2. The structure of claim 1 wherein said means to sense a predetermined amount of water in said water storage tank comprises:

a float chamber disposed above said tank drain in said water storage tank, said float chamber having a plurality of float chamber apertures defined at the base thereof;

a float member disposed within said float chamber;

a drain plug disposed wtihin said tank drain;

means to control the opening and closing of said drain plug operable by the user of said shower;

a shaft member having a first and second end, said first end being attached to said float member; and a switch member disposed above said shaft member attached to the second end of said shaft member adapted to be switched by the movement of said float member within said float chamber, said switch member further adapted to turn said pump on when said float member is disposed within an upper portion of said float chamber due to said drain plug being closed and said float chamber filling with water from said water storage tank and said float member floating in said water held in said float chamber and said switch member adapted to shut off said pump when said float member is at a low position within said float chamber not being supported by water within said float chamber when said drain plug is in an open position thereby allowing water to drain from said water storage tank through said tank drain.

3. The structure of claim 2 wherein said means to direct water flow comprises a flow control valve having a first pressure-activated valve associated with said fresh cold water inlet and a second pressure-activated valve associated with said fresh hot water inlet, said first and second pressure-activated valves being interconnected with said recycle water pipe and adapted to be activated upon sensing of water pressure within said recycle water pipe, said water pressure caused when said pump directs a flow of water from said water storage tank through said recycle water pipe and to said flow control valve creating pressure on said first and second pressure-activated valves which pressure causes said pressure-activated valves to shut off the flow of fresh water from said fresh hot and cold water sources and in the second mode to direct water coming through said recycle water pipe to said cold and hot water inlets of said shower head, said flow control valve further adapted that upon cessation of pressure from said water recycle pipe, said first and second pressure-activated valves return to their first mode ceasing the flow of water from said water recycle pipe to the hot and cold water inlets of said shower head and then redirect the fresh hot and cold water flow to said hot and cold water inlets of said shower head.

* * * * *